US005775461A

United States Patent [19]

Vandelinde

[11] Patent Number: 5,775,461

[45] Date of Patent: Jul. 7, 1998

[54] LINK LADDER SYSTEM

[76] Inventor: Henry Vandelinde, 22521 Warden Avenue, R.R. 1, Queensville, Ontario, Canada, L0G 1R0

[21] Appl. No.: 626,422

[22] Filed: Apr. 2, 1996

[51] Int. Cl.[6] ..... E06C 1/52

[52] U.S. Cl. ..... 182/93; 182/156

[58] Field of Search ..... 182/93, 95, 196–199, 182/116, 163, 164, 159, 160, 151, 156

[56] References Cited

U.S. PATENT DOCUMENTS

| | | | |
|---|---|---|---|
| 271,809 | 2/1883 | Dearborn | 182/95 |
| 600,346 | 3/1898 | Hensel | 182/197 |
| 1,203,313 | 10/1916 | Danke | 182/95 |
| 5,211,260 | 5/1993 | Troycen | 182/164 |
| 5,540,178 | 7/1996 | Damron | 182/196 |

FOREIGN PATENT DOCUMENTS

| | | | |
|---|---|---|---|
| 468422 | 7/1914 | France | 182/160 |
| 1313696 | 12/1962 | France | 182/93 |
| 679440 | 8/1979 | U.S.S.R. | 182/93 |

*Primary Examiner*—Alvin C. Chin-Shue
*Attorney, Agent, or Firm*—Robert P. Stratton; Arne I. Fors

[57] ABSTRACT

A ladder system comprising a plurality of ladder segments arranged in seriatim. Each segment includes two sections joined by a hinge such that a portion of the segment may engage an object to be scaled. A retaining device is provided on each segment to maintain the segment in engagement with the object and each segment includes a riser portion which, when the segments are properly placed, forms the risers of a ladder. Adjacent segments are connected and are positioned in place on the object, by a user who pulls them into position one at a time.

8 Claims, 4 Drawing Sheets

LINK LADDER SYSTEM

FIELD OF THE INVENTION

The present invention relates to ladder systems. More specifically, the present invention relates to a ladder system wherein segments of a ladder can be placed, in a serial manner, on an object to be scaled as the user climbs the segments of the ladder which have already been placed.

BACKGROUND OF THE INVENTION

Sectioned ladder systems are known and are used in many different fields. One common use of sectioned ladder systems is for linemen or other service personnel to climb electrical or telephone poles. One prior art system for such uses comprises a series of short sections of ladder which are strapped to the pole or object to be scaled. In this system, the user straps a ladder section, which may include three, four or more rungs, to the bottom of the pole and climbs that positioned ladder section while carrying at least the next ladder section which is to be positioned. The user then straps the carried section into place atop the first positioned section and climbs the newly placed section. This process is repeated until the assembly of ladder sections reaches the desired height.

However, problems exist with this prior art system in that either a user must make a number of trips up and down the positioned ladder sections to carry up subsequent sections for placement or a user must carry multiple sections which are to be positioned in turn. In the former case, assembly of the ladder can be very tiring and can require a good deal of time. In the latter case, the difficulty a user experiences in positioning a ladder section while holding one or more additional ladder sections results in a decreased safety factor and also increases the difficulty of assembling the ladder. Also, as the ladder sections are carried up the side of the object on which the ladder sections are being positioned, the weight of the ladder sections generally acts to pull the user away from the positioned ladder sections, thereby increasing the risk of the user falling from the ladder.

It is therefore desired to have a ladder system which allows the relatively simple, quick and safe assembly of a ladder on an object to allow a user to scale the object.

SUMMARY OF THE INVENTION

It is an object of the present invention to provide a novel ladder system which obviates or mitigates at least one disadvantage of the prior art.

According to a first aspect of the present invention, there is provided a ladder system formed of a plurality of ladder segments arranged in seriatim, each ladder segment comprising: first and second segment sections, each of which includes an abutment portion to abut an object to be scaled and a riser portion to provide support for a user; hinge means to connect said first and second segment sections; retaining means to maintain said abutment portions in engagement with said object to be scaled; and linking means to pivotally connect said ladder segment to an adjacent ladder segment.

According to another aspect of the present invention, there is provided a ladder segment for a ladder system, comprising: first and second segment sections each including a riser portion to form a climbing surface in said ladder system and an abutment portion to engage an object to be scaled; hinge means to connect said first and second segment sections and to allow said abutment portions to be placed into engagement with an object to be scaled; retaining means to maintain said abutment portions in said engagement; and linking means to pivotally connect said segment to receive another said segment.

According to yet another aspect of the present invention, there is provided a method of installing a ladder system comprising a series of pivotally connected segments to scale an object, comprising the steps of:

(i) engaging abutment portions of a segment to said object;

(ii) establishing a retaining means to maintain said abutment portions of said segment in engagement with said object;

(iii) climbing a previously positioned segment;

(iv) repeating steps (i), (ii) and (iii) in turn for each subsequent segment in said series until said ladder system is in place on said object.

Preferably, the linking means is the hinge means. Also preferably, the hinge means is resilient to accommodate differences in the shape and/or size of the object to the scaled and the abutment portions. Also preferably, the retaining means comprises a strap with a cinch and one removable end, the strap extending from said first segment section to said second segment section. More preferably, said strap extends from the first segment section of two adjacent segments and removably engages the second segment section of said two adjacent segments.

According to yet another aspect of the present invention, there is provided a method of installing a ladder system comprising a series of pivotally connected segments to scale an object, comprising the steps of: (i) engaging abutment portions of a ladder segment to said object; (ii) establishing a retaining means to maintain said abutment portions of said ladder segment in engagement with said object; (iii) climbing a previously positioned ladder segment; (iv) repeating steps (i), (ii) and (iii) in turn for each subsequent ladder segment in said series until said ladder system is in place on said object.

BRIEF DESCRIPTION OF THE DRAWINGS

Embodiments of the present invention will now be described, by way of example only, with reference to the attached Figures, wherein.

DETAILED DESCRIPTION OF THE INVENTION

Figure 1:
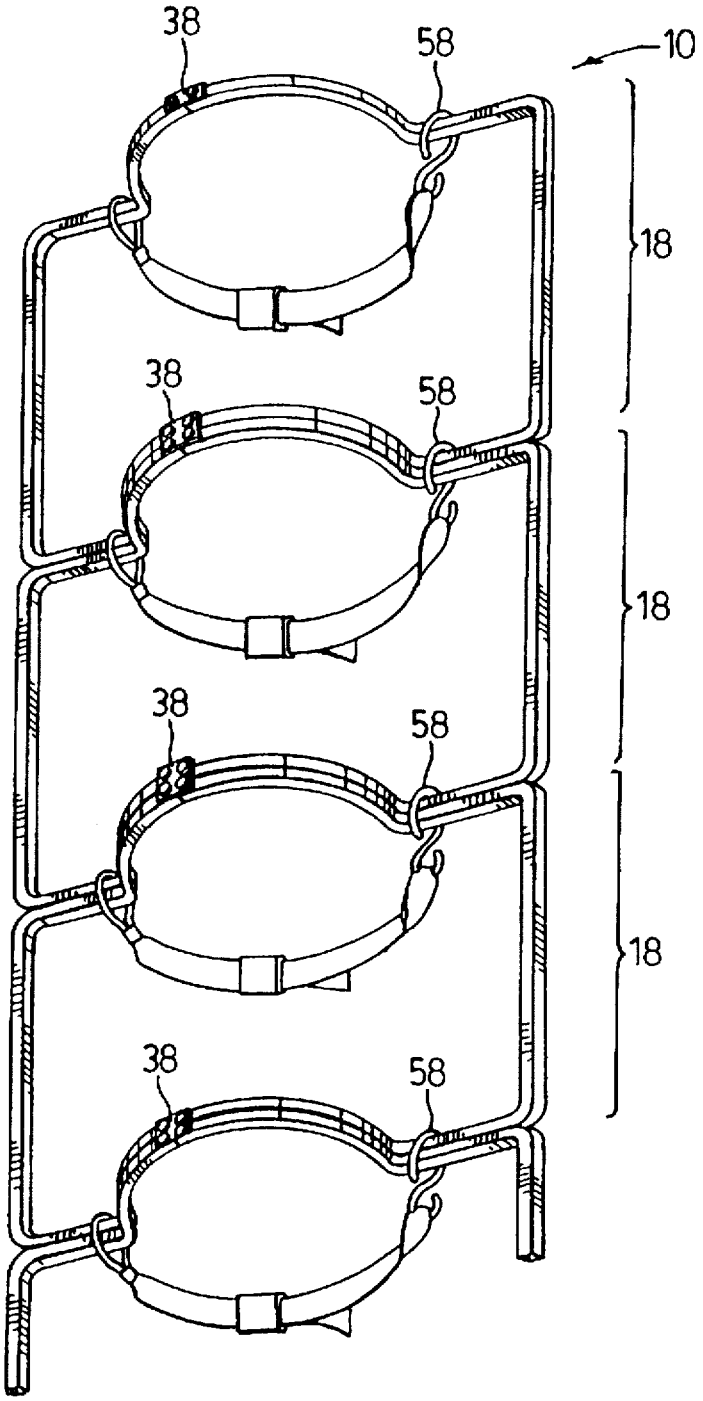
FIG. 1 is a rear view of a series of ladder segments in accordance with the present invention.
Figure 2:
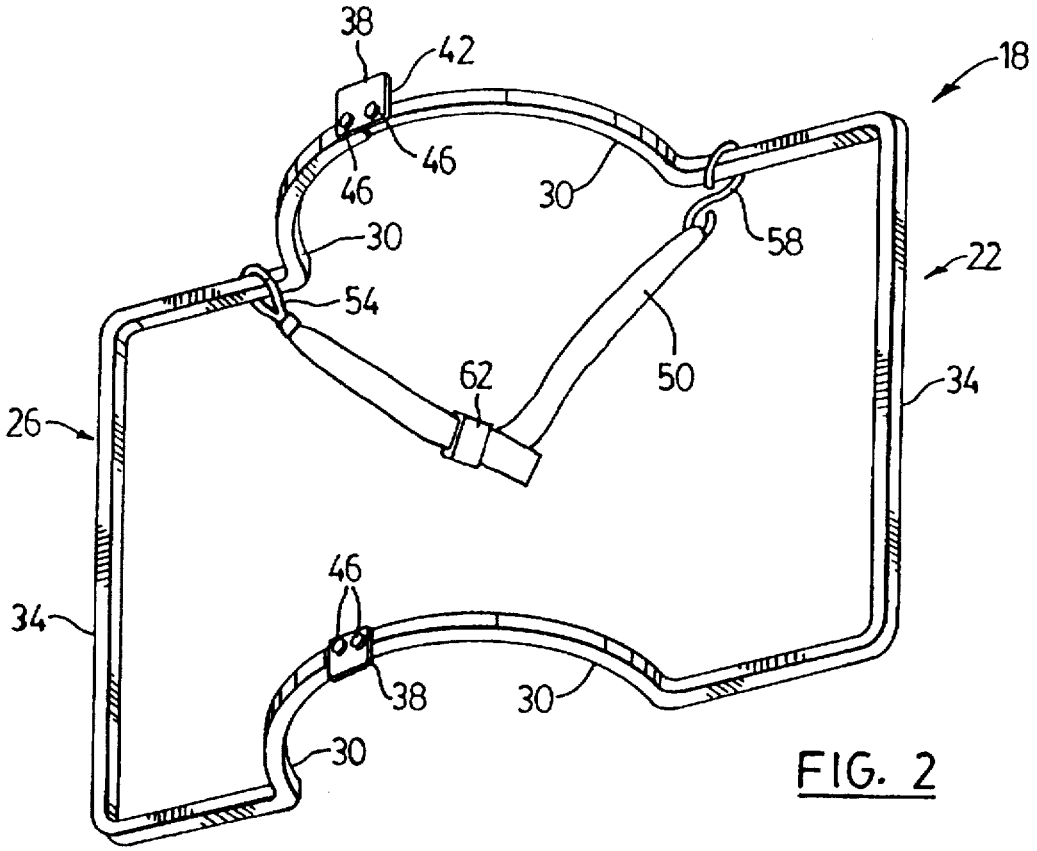
FIG. 2 shows a rear view of a ladder segment of FIG. 1.

A ladder system in accordance with the present invention is indicated generally at 10 in FIG. 1. Ladder system 10 comprises a plurality of ladder segments 18, as best seen in FIG. 2, each of which includes a first segment section 22 and a second segment section 26. Each segment section 22 and 26 includes upper and lower abutment portions 30, which are intended to abut the object to be scaled, and riser portions 34. In the present embodiment, segment sections 22 and 26 are fabricated from aluminum bar. It is contemplated however, that segment sections 22 and 26 can also be fabricated from extruded aluminum tubing, reinforced plastic materials or any other suitable material as would occur to those of skill in the art.

Figure 3:
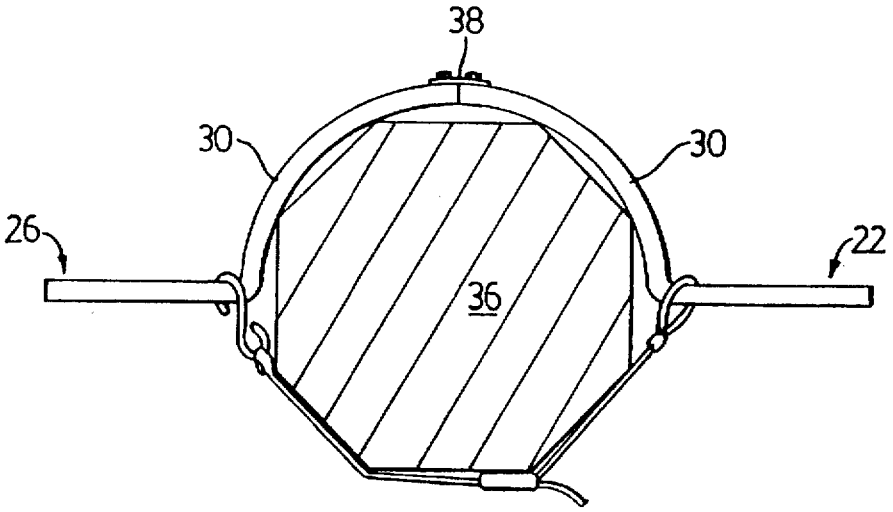
FIG. 3 shows a cross section of the ladder segment of FIG. 2 positioned on an object to be scaled.

In the embodiment shown in the Figures, abutment portions 30 are generally round when viewed from above or below, as shown in FIG. 3, and are intended to abut objects which are round, or near-round, in cross section. Object 36 in FIG. 3 is an example of an object with a near-round cross section and specifically is octagonal in cross section. It will be apparent to those of skill in the art that objects of other cross-sections, such as triangular or square, may also be scaled with the present invention. It is contemplated however, that other shapes may be preferred for abutment portions 30 depending on the cross-section of the object which is intended to be scaled. For example, each abutment portion 30 can be shaped to define complementary quarters of a square to engage an object with a square cross-section.

In the embodiment of the invention shown in FIGS. 1 through 4, segment sections 22 and 26 are joined to one another via an upper and a lower hinge means 38 which allows segment section 22 to pivot with respect to segment section 26. In this manner, abutment portions 30 can be brought into pincher-like engagement with the object to be scaled, as described below.

In this embodiment, each hinge means 38 comprises a pad 42 of neoprene rubber which is fastened with suitable fasteners 46 to each abutment portion 30 of segment sections 22 and 26 to form a hinge therebetween. If desired, pad 42 can be reinforced via a steel cable (not shown) which extends between fasteners 46 on each of segment section 22 and segment section 26. It is also contemplated that at least one of fasteners 46 will be removable such that segments 18 may be disassembled for transportation or storage of ladder system 10.

Each ladder segment 18 also includes a retaining means which acts to maintain a ladder segment 18 in abutment with the object to be scaled. In an embodiment of the invention, the retaining means comprises a strap 50 which has one end 54 fastened to segment section 26 and which includes a hook 58 or snap shackle (not shown) at the other to engage segment section 22. The length of strap 50 can be adjusted via an adjustment means, such as cinch 62, to ensure that segment 18 firmly engages the object being scaled.

While FIG. 2 shows strap 50 in place on a single segment 18, it is preferred that end 54 of strap 50 be fastened about two adjacent segment sections 26 as shown in FIG. 1. Similarly, hook 58 preferably engages two adjacent segment sections 22 when it is properly positioned, as is also shown in FIG. 1. It is contemplated that by spanning adjacent segments 18, end 54 and hook 58 will maintain segments 18 in abutment with the object to be scaled and will assist in maintaining the relative positioning of the adjacent segments 18.

Figure 4:
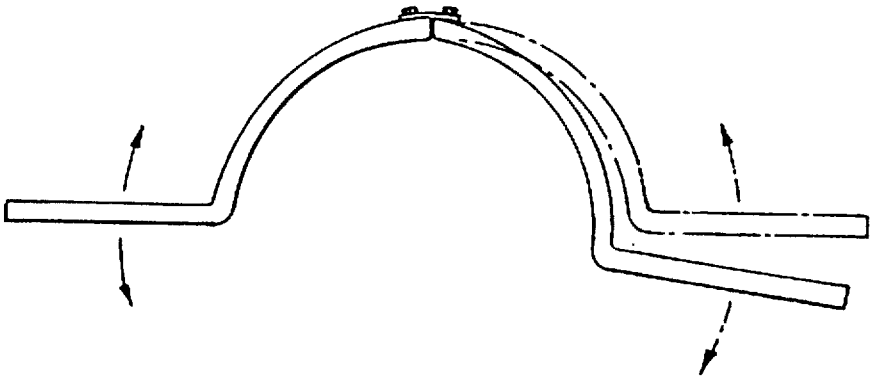
FIG. 4 shows the relative movement of the sections comprising a ladder segment in accordance with the present invention.

FIG. 3 shows a segment 18 in place on an object 36. When strap 50 is properly set, tension is exerted on riser portions 34 to pull them to the front of object 36, placing pad 42 into tension and resulting in abutment portions 30 securely engaging object 36 in a pincher-like manner. While it is not essential that hinge means 38 be formed from a resilient material, such as pad 42, such a tensionable hinge means is presently preferred to provide secure engagement of segment 18 with object 36. FIG. 4 shows the pincher-like movement of sections 22 and 26 which is employed to securely engage the object to be scaled.

When ladder system 10 is formed from the plurality of segments 18, as shown in FIGS. 1 and 4, a pivotal connection is also established between adjacent segments 18. In an embodiment of the present invention, hinge means 38 is employed to also provide this pivotal connection. Specifically, pad 42 is sized such that each of segment sections 22 and 26 of adjacent segments 18 can be fastened to pad 38. If desired, pad 42 can be reinforced via steel cables (not shown), one of which extends between fasteners 46 of corresponding sections 22 and 26 of a segment 18 and the second of which extends between a fastener 46 on each of the adjacent segment sections 18. It is contemplated that other suitable means, as will occur to those of skill in the art, can be employed to establish the pivotal connection between adjacent segments 18, for example, a short piece of steel cable or the like can be fastened between each segment 18.

It is contemplated that additional segments 18 may be added to or removed from ladder system 10 to increase or decrease, as desired, the height which may be scaled. It is also contemplated that, for objects whose cross section changes with height, such a lamp posts which taper, ladder system 10 may be assembled from segments 18 with different sizes of abutment portions 30 in order to ensure that abutment portions 30 properly engage the object being scaled. As will be apparent, adjacent segments 18 may also be disconnected, if desired, to allow ladder system 10 to be more easily stored and/or transported. In the case wherein it is desired that adjacent segments 18 be disassembled or additional segments 18 be added, end 54 of strap 50 is fastened in a removable manner so that assembly and disassembly may be accomplished.

Figure 5:
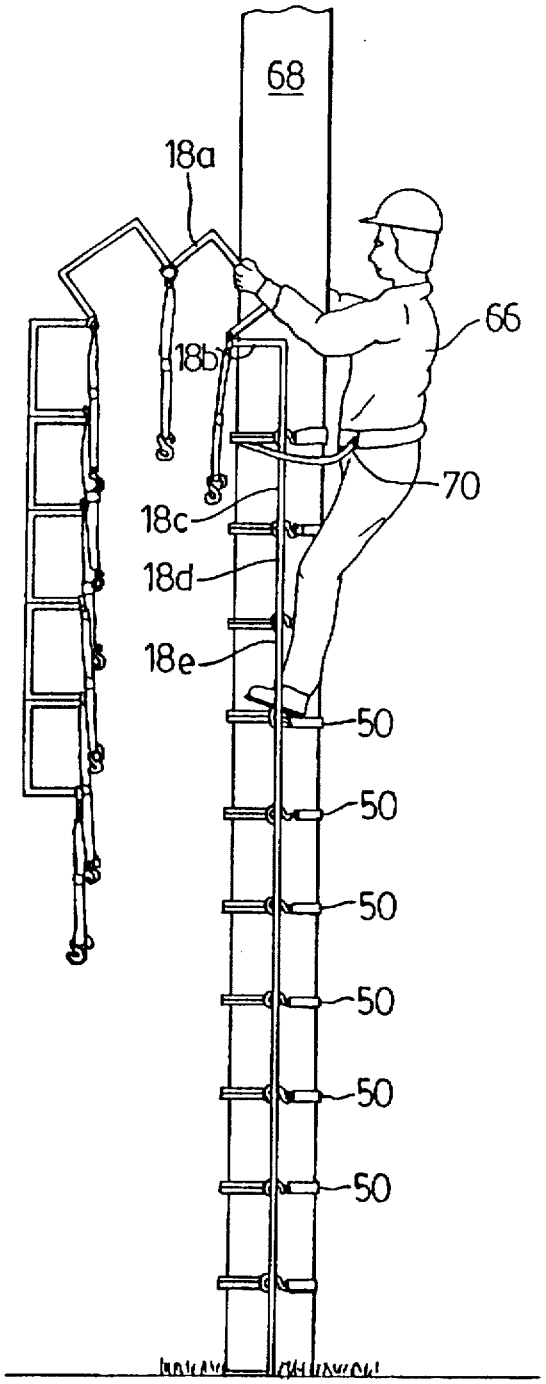
FIG. 5 shows a user positioning a ladder system in accordance with the present invention while scaling an object.

FIG. 5 shows a ladder system 10, in accordance with the present invention, in use. In the Figure, the user 66 has already placed the majority of segments 18 into position on an object 68 and is in the process of placing the next non-positioned segment **18*a* into position on object 68. As can be seen, each preceding segment 18 has been positioned on object 68 and their respective straps 50** have been tightened appropriately.

To position segment **18*a*, after segment 18*b* has been placed, user 66 climbs up from segment 18*e* to segment 18*d*, stepping on to the bottom horizontal portion of riser portion 34 of segment 18*d*, and pulls segment 18*a* up to place it into engagement with object 68. Hook 58 of the strap 50 which is shared between segments 18*a* and 18*b* is fastened securely to segment sections 22 of segments 18*a* and 18*b*, the combination of the segment sections 22 and 26 and strap 50 effectively surrounding object 68. The process is then repeated for the next segment. As will be apparent, removal of ladder system 10** is effected by reversing these steps.

It should also be noted that, due to the shape of segments 18 and the process by which they are placed on the object to be scaled, user 66 places each segment 18 into position using both hands, with a relatively equal distribution of the load. It is contemplated that this two-handed, equal-loading placement technique reduces the likelihood of back injury or other lifting related injury to user 66.

As shown in FIG. 5, user 66 has a safety belt 70 which encircles object 68 and the installed portion of ladder system 10. It is contemplated that another advantage of the present invention is that, in the event that user 66 falls, segments 18 provide a plurality of points at which safety belt 70 may catch thereby arresting the fall. If desired, a bracket (not shown) for attaching a safety line may be provided on the topmost segment 18 of ladder system 10. In the event that user 66 is required to make repeated trips up and down ladder system 10, a safety line may be attached to the bracket for use with a travelling fall arrest anchor employed by user 66.

Figure 6:
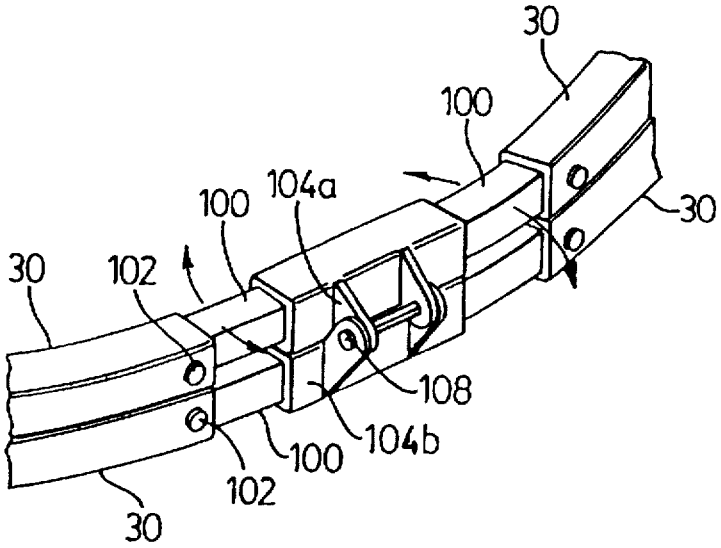
FIG. 6 shows a partially cut away view of a hinge and linking mechanism.

FIG. 6 shows another embodiment of segments 18 which is presently preferred. Specifically, in this embodiment the abutment portion 30 of each segment section 22,26 mates to a resilient member 100, via a suitable fastener 102, and resilient member 100 in turn mates with a collar member 104. Resilient members 100 can be fabricated of any appropriate material, such as a portion of urethane bar, and provide a desired amount of flex between segment sections 22,26 to achieve the above-described pincher-like engagement of abutment portions 30 with the object to be scaled.

As shown in the Figure, collar members 104*a*, 104*b* on adjacent segments 18 are pivotally joined via pin 108 to form a link between adjacent segments 18. It is contemplated that in some embodiments, pin 108 will be removable thereby allowing ladder system 10 to be disassembled for transportation and/or storage as with the previous embodiment. Further, as will be apparent, additional segments 18 may be added to either end of ladder system 10 to lengthen the ladder by connecting, with a pin 108, the collar member 104 of an additional segment 18 to the collar member 104 of a terminal segment 18 of ladder system 10. In a similar fashion, ladder system 18 can be shortened by removing pin 108 from a segment 18.

Ladder system 10 of the present invention provides significant advantages over prior art ladder systems. Specifically, unlike the case with prior art ladder systems wherein a user may be required to climb the ladder carrying ladder segments equivalent to up to 90% of the length of the ladder system, the maximum amount of ladder system 10 which user 66 will lift during installation of ladder system 10 is one half of the total length of ladder system 10. It should also be noted that the amount of ladder system 10 which a user must lift starts at zero and increases by one segment 18, each time a segment 18 is placed on object 68, until the maximum of one half of the length of ladder system 10 is obtained. After this point, the amount which a user must lift decreases by one segment 18 each time a segment 18 is placed.

Also, unlike prior art ladder systems of which the inventor is aware, the process of installing ladder system 10 results in user 66 pulling himself towards object 68 as he positions each successive segment 18 on the side of object 68 which is opposite to that being scaled. In prior art ladder systems, the user positioned the ladder segments on the face of object 68 which was being scaled and thus the user was often pulled away from object 68, resulting in an increased safety risk to the user. In the present invention, the user is positioning segments 18 on the side of object 68 opposite the side the user is on, thus resulting in the user being pulled toward the object being scaled.

The above-described embodiments are intended to be examples of the present invention and alterations and modifications may be effected thereto, by those of skill in the art, without departing from the scope of the invention which is defined solely by the claims appended hereto.

We claim:

1. A ladder system formed of a plurality of ladder segments arranged in seriatim, each ladder segment comprising:

first and second segment sections, each of which includes upper and lower abutment portions to abut an object to be scaled and a riser portion interconnecting said upper and lower abutment portions to provide support for a user;

upper and lower hinge means to connect said first and second segment sections;

retaining means removably attachable to the first and second segment sections to maintain said abutment portions in engagement with said object to be scaled; and linking means to pivotally connect said ladder segment to an adjacent ladder segment.

2. A ladder system according to claim 1 wherein said hinge means is said linking means.

3. A ladder system according to claim 2 wherein each said hinge means is in the form of a pad of resilient material.

4. A ladder system according to claim 1 wherein said retaining means comprises a strap including a first end connected to the upper abutment portion of said first segment section and a section end including a fastener to removably engage the upper abutment portion of said second segment section.

5. A ladder system according to claim 4 wherein said strap further includes adjustment means to alter the effective length of said strap.

6. A ladder system according to claim 5 wherein said first end is connected to the first sections of adjacent segments and said fastener removably engages corresponding second sections of adjacent segments.

7. A ladder segment for a ladder system, comprising:

first and second segment sections each including a riser portion to form a climbing surface in said ladder system and upper and lower abutment portions interconnected by said riser portions to engage an object to be scaled;

upper and lower hinge means to connect said first and second segment sections and to allow said abutment portions to be placed into engagement with an object to be scaled;

retaining means removably attachable to the upper abutment portions to maintain said abutment portions in said engagement; and linking means to pivotally connect said segment to receive another said segment.

8. A ladder segment according to claim 7 wherein said hinge means comprises a resilient member extending between said first and second segment sections.

* * * * *